US005450909A

United States Patent [19]

Stevenson

[11] Patent Number: 5,450,909

[45] Date of Patent: Sep. 19, 1995

[54] GRADE DETERMINING METHOD AND APPARATUS

[76] Inventor: Robert Stevenson, NC - 65, Box 20, Austin, Nev. 89310

[21] Appl. No.: 165,637

[22] Filed: Dec. 13, 1993

[51] Int. Cl.[6] ..... A01B 39/20; A01B 35/20

[52] U.S. Cl. ..... 172/430; 33/263; 33/285; 33/288; 37/906

[58] Field of Search ..... 172/430; 37/906; 116/DIG. 13; 33/252, 285, 286, 288, 521, 1 H, 624

[56] References Cited

U.S. PATENT DOCUMENTS

| | | | |
|---|---|---|---|
| 2,292,241 | 8/1942 | Reeves | 116/DIG. 13 |
| 2,486,697 | 11/1949 | White | 172/430 |
| 2,565,615 | 8/1951 | McCoy | 172/430 |
| 2,782,525 | 2/1957 | Eubank | 33/624 |
| 3,462,845 | 8/1969 | Matthews | 172/430 |
| 3,564,531 | 2/1971 | Burgin | 33/333 |
| 3,900,073 | 8/1975 | Crum | 172/430 |
| 4,300,271 | 11/1981 | Wohlhaupter | 403/381 |
| 4,393,596 | 7/1983 | Gerber | 172/430 |
| 4,511,005 | 4/1985 | Brown | 172/430 |
| 4,919,214 | 4/1990 | Brown | 172/430 |
| 5,094,001 | 3/1992 | Fraser | 33/624 |
| 5,146,686 | 9/1992 | Brown | 172/430 |

*Primary Examiner*—Randolph A. Reese
*Assistant Examiner*—Spencer Warnick
*Attorney, Agent, or Firm*—Herbert C. Schulze

[57] ABSTRACT

A method and apparatus for determining the degree of grade ( slope ) upon which an earth moving machine is operating wherein a movable sighting device is mounted on the machine in such manner that the forces of gravity cause the device to move such that an operator looking at external reference objects may control and confirm the angle of grade ( slope ) of the earth being worked upon.

8 Claims, 4 Drawing Sheets

Fig. 1.
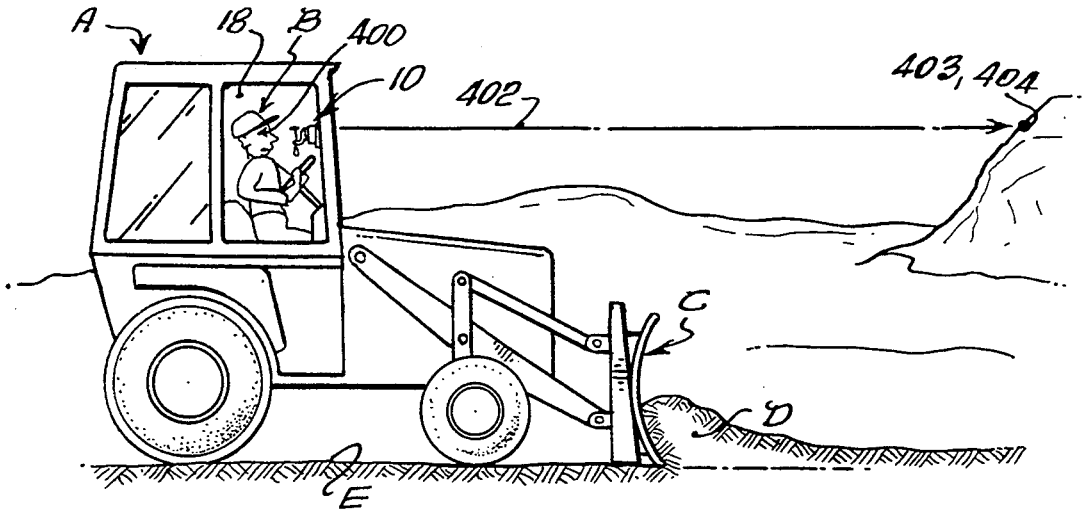
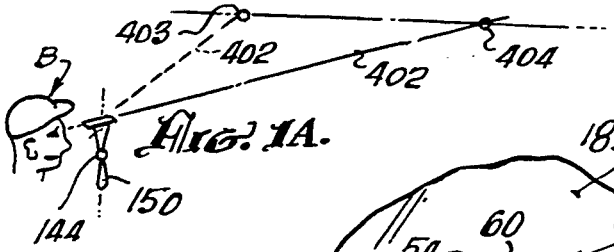
Fig. 1A.
Fig. 2.
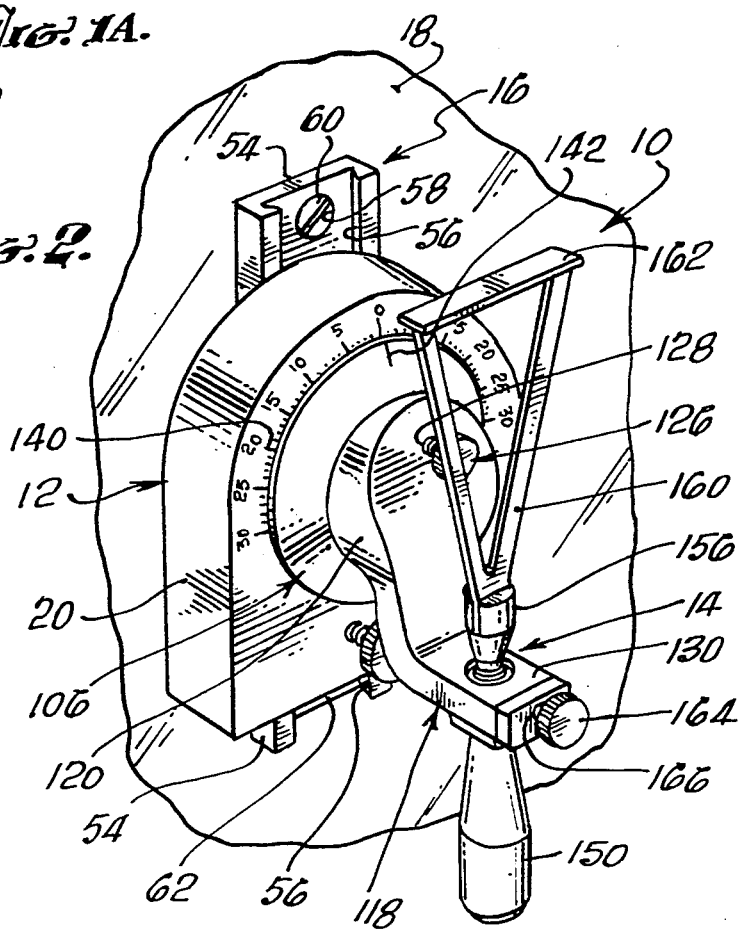

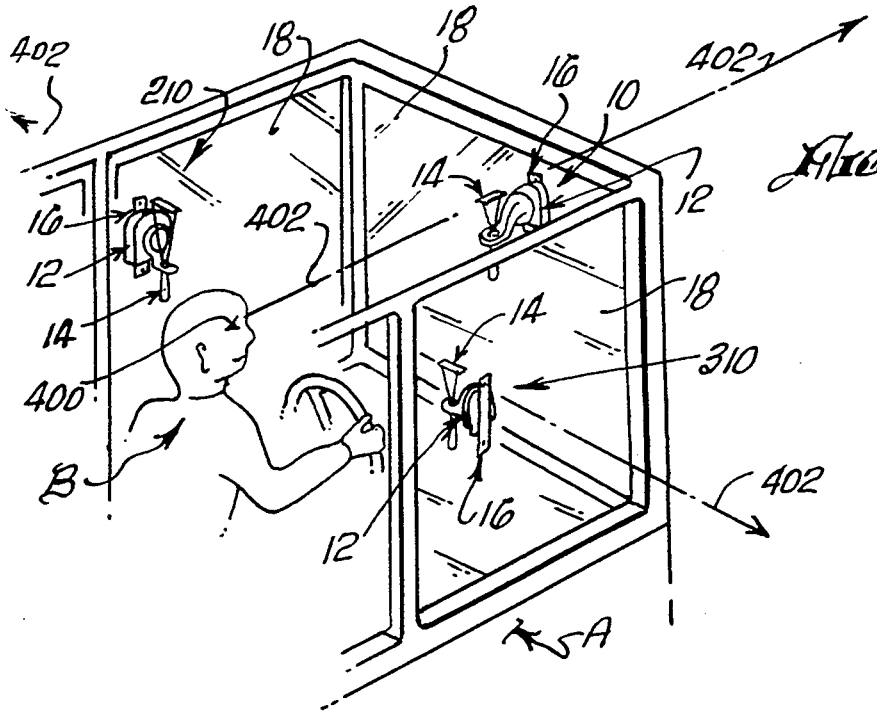
FIG. 5.
FIG. 6.
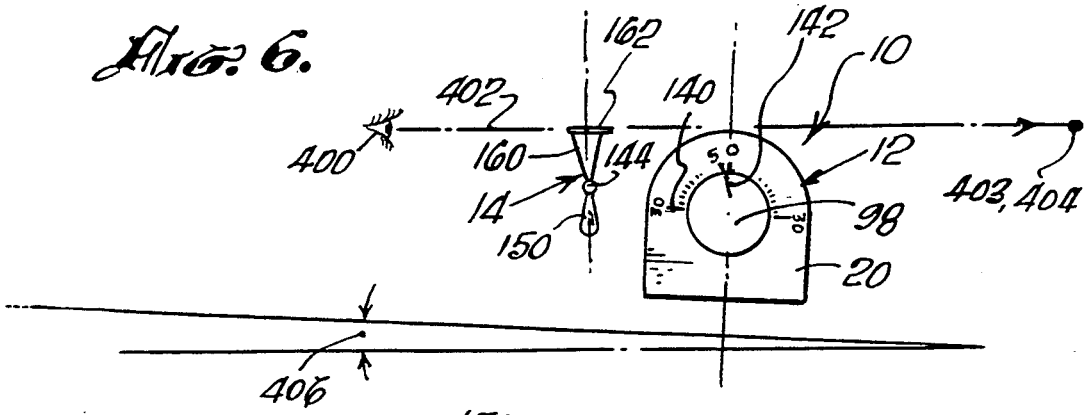
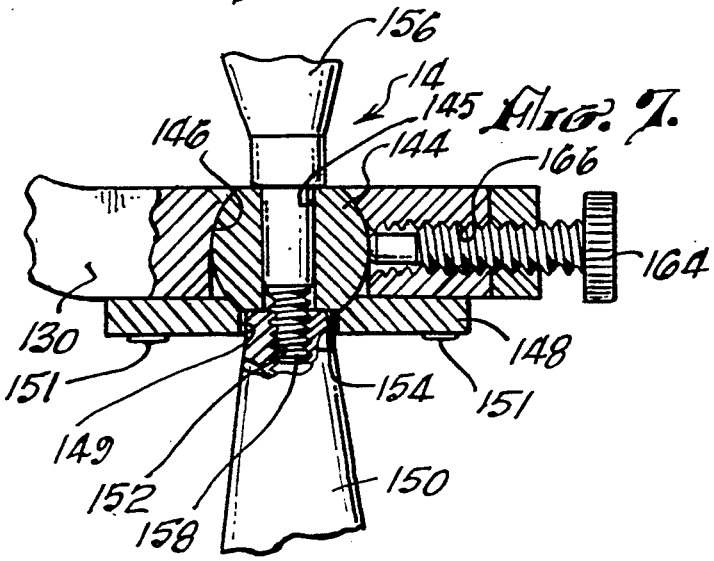
FIG. 7.

GRADE DETERMINING METHOD AND APPARATUS

BACKGROUND OF THE INVENTION

1. Field of the Invention

This invention is in the general field of determining the relationship of earth handling machines, such as bulldozers and the like, to their location relative to grade, and to surrounding reference points.

2. Description of the Prior Art

Various prior art devices have been developed to determine the angle of earth moving machines.

U.S. Pats. Nos. 2,189,699 (Blunk), 2,333,988 (Demond), 2,412,831 (Owens), 2,467,157 (Schiavi), 2,486,697 (White), 2,565,615 (McCoy), and 3,564,531 (Burgin) show pendulums or other angle sensing mechanisms with pointers directly attached. These pointers point to markings on dials which indicate pendulum angle. The pointers move the same number of degrees as their corresponding pendulums. A difficulty found with this arrangement is that precise angle readings require long pointers and large dials.

U.S. Pat. No. 4,511,005 (Brown) shows a pendulum which drives a pointer via a pair of gears. The gear teeth are exposed to open air, and thus are vulnerable to dust contamination. Dust contamination is a major consideration, since earth moving machinery often operates in dusty environments. Furthermore, the Brown apparatus is large in overall height.

U.S. Pat. No. 2,412,831 (Owens) shows another angle measuring device with gearing to enable precise angle settings. The gears of this device are also exposed to air. Furthermore, these gears and their appended wheels only partially overlap each other, taking up more space than would fully overlapping wheels of the same size.

Devices of the prior art have generally been found to suffer from one or more of the following drawbacks: large bulk and/or weight, high manufacturing cost, inconvenient operation, and inaccuracy.

OBJECTS OF THE INVENTION

The objects of the invention include:

(a) to provide a method and apparatus for determining whether an earth moving machine is performing at level or at a desired angle;

(b) to provide a method and apparatus for determining the slope of the grade that the machine is operating on;

(c) to provide a method and apparatus for accomplishing the above which is accurate;

(d) to provide a method and apparatus for accomplishing the above which is fast and easy to use;

(e) to provide a method and apparatus for accomplishing the above which provides an easily observable angle reading;

(f) to provide a method and apparatus for accomplishing the above which is compact in size and lightweight (g) to provide a method and apparatus for accomplishing the above wherein the apparatus may be used while located near the operator during his handling of the machine, (h) to provide a method and apparatus for accomplishing the above which is inexpensive to manufacture, (i) to provide a method and apparatus for accomplishing the above wherein the apparatus is resistant to dust contamination, and;

(j) to provide a method and apparatus for accomplishing the above wherein the apparatus may be quickly and easily installed or removed.

The foregoing and other objects and advantages of this invention will become apparent to those skilled in the art upon reading the description of a preferred embodiment which follows, in conjunction with a review of the appended drawings.

SUMMARY OF THE INVENTION

The present invention provides a method to assist an operator of an earth moving machine to form a desired grade and/or to check the grade upon which his machine is currently resting. This method includes mounting a grade measuring apparatus on the earth moving machine. This apparatus includes a main body member mounted on the machine and a sighting device for determining alignment with an external object.

A sighting device as defined in this specification and appended claims is any of various mechanical or optical devices which are used to determine an alignment with an external object or landmark. Rifles and other firearms are generally equipped with sighting devices. These devices may be the simple front and rear bead arrangements of common rifles, or telescopic. A Pro-Sight level may be used. This device is available via the Improvements (tm) Co., 4944 Commerce Parkway, Cleveland, Ohio 44128. The sighting device may also comprise a laser. An advantage of a laser sight is that the operator would not have to position his head in a precise location near the apparatus to check whether the machine is angled properly. Also,, with a laser sight, the operator could continuously monitor whether the machine is maintaining a desired grade, even while the machine is in motion.

In the preferred embodiment described below, the sighting device is a horizontal wire circle which can be used to sight objects over 360 degrees. The sighting device shown in the drawing figures is a horizontal bar.

The sighting device establishes a sight line. As will be explained in the Operation section below, sometimes the sighting device is resting at a known angle and the sight line is used to establish a landmark; sometimes the landmark is preestablished and the sight is moved (by itself or with the earth moving machine) to place the landmark in the sight line.

The sighting device is mounted on a support structure, or sighting assembly, which is swingably mounted on the main body member via a swing mount. A swingably mounted device, as defined in this specification and appended claims is a device which is allowed to swing, or rotate, by force of gravity around a substantially horizontal axis and to come to rest at an equilibrium position. Equilibrium position is defined below. The swing mount may be embodied in numerous forms. A hinge, axle & bearing, and leaf spring are among the various types of swing mounts which may be employed. In the preferred embodiment, two swing mounts are used in conjunction-an axle rotating on bearings and a ball pivot. One advantage of the ball pivot is that the sighting device may swing around any horizontal axis and may rotate on a vertical axis as well.

A plumb may also be employed, rigidly attached to the sighting assembly opposite the sighting device. With this feature, the sighting device may be disposed above the horizontal axis when the sighting assembly is hanging in equilibrium position. Thus, the support structure for the sighting device is disposed below the sighting device, allowing an unobstructed view above and around the sighting device.

The horizontal axis which the sighting assembly swings around is disposed at an angle to the sight line. (If the sight line and the swing axis were parallel, then swinging of the sighting device would produce little, if any, change in the location of the sight line.) For maximum accuracy, this angle should be 90 degrees. However, lesser angles will also produce satisfactory results.

A manually controlled securement mechanism for preventing swinging of the sighting assembly is provided. In the preferred embodiment this mechanism is a thumb screw. Other clamping devices may be used.

Angle indicating means are provided for determining the angle of the sighting device relative to the main body member. In the preferred embodiment, these means are a dial with degree markings and a slash mark to point to these markings. Other means may be employed, including an electronic sensing device with a digital or other readout or a rotating drum with degree markings.

These angle indicating means are calibrated to read zero when the sighting assembly is hanging in equilibrium position and the earth moving machine is resting on a horizontal surface. Equilibrium position is the position wherein the mass center of the assembly is at the lowest elevation allowed by the swing mount. If the swing mount is a ball pivot, as shown in the preferred embodiment, the mass center of the assembly will be directly below the swing mount when the assembly is in equilibrium position.

Various methods of operating the apparatus are explained below in the Operation section.

A plurality of mounting devices may be affixed to the machine whereby one apparatus may be easily moved from one mounting device to another. In this manner, one apparatus may be used to measure grade along a lateral or longitudinal axis with respect to the road. This point is explained in greater detail in the Operation section.

BRIEF DESCRIPTION OF THE DRAWINGS

FIG. 1 is a side elevational view of an apparatus suitable to practice the method of this invention mounted in the cab of a bulldozer and in the proximity of the operator;

FIG. 1A is a simplified perspective view of a portion of FIG. 1 wherein the operator is shown sighting the invention onto two reference points;

FIG. 2 is an enlarged fragmentary perspective view of the grade and level determining apparatus of this invention;

FIG. 5 is a schematic perspective showing the device of FIG. 2 as it can be installed in different locations near the operator of the earth handling machine;

FIG. 6 is a simplified schematic of the device of FIG. 2 as it would be used in determining the grade the machine is operating on;

FIG. 7 is an enlarged fragmentary view, partly in section, of the swivel and locking screw which supports the sighting assembly of FIG. 2;

DESCRIPTION OF A PREFERRED EMBODIMENT

FIG. 1 shows an earth handling machine A, (in this case a bulldozer) with an operator B at the controls.

The blade C is shown cutting into and moving a layer of ore or other material D as the machine moves along the ground at a level E.

Mounted in the cab portion is the apparatus 10 of the present invention. The manner in which this grade and level determining apparatus is operated will be described in the Operation section below.

Figure 8:
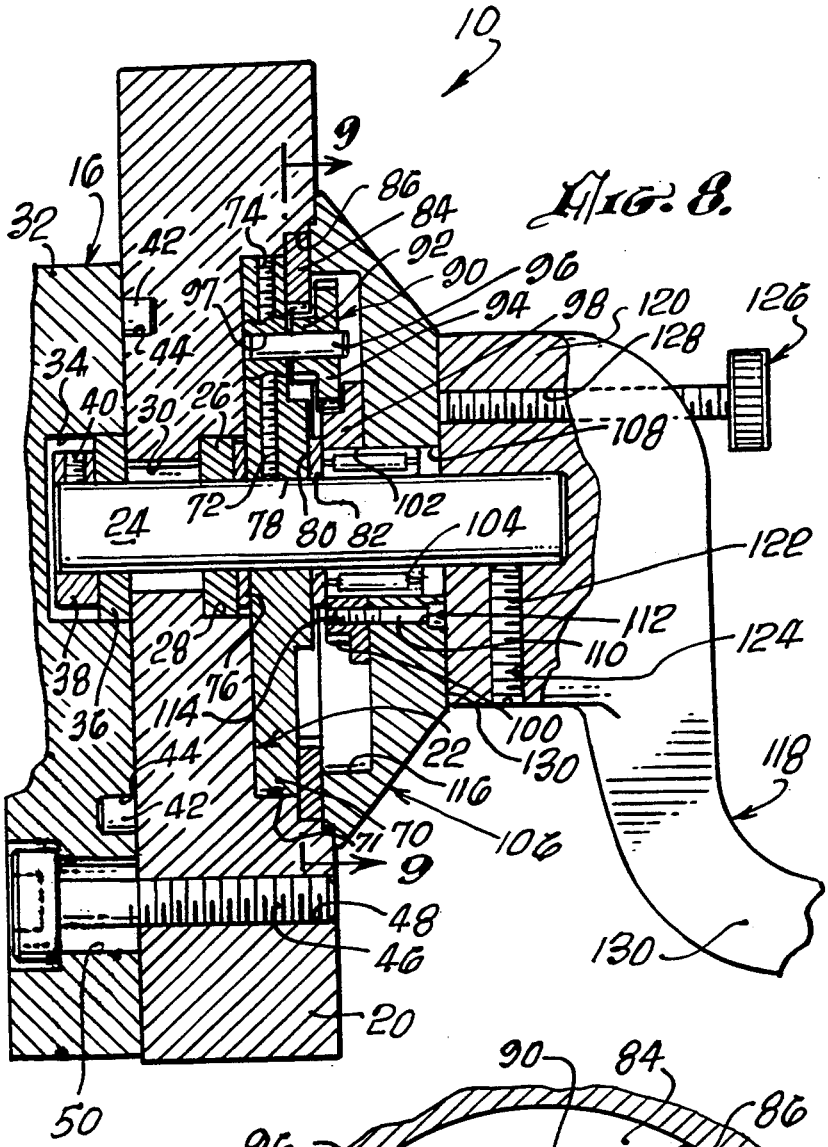
FIG. 8 is an enlarged sectional view, partly in elevation, of the device of FIG. 2.

Referring to FIGS. 2 and 8, a main body portion 12 which can be constructed out of a lightweight but sturdy material, such as aluminum, supports a sighting and plumbing assembly 14.

A mounting assembly, generally referred to by the reference numeral 16, is seen to be affixed to a window or panel 18 at the eye level of the seated operator. This window can be the windshield, or any of the side windows of the cab as seen in FIG. 5. It is also possible to mount the apparatus 10 to a mounting assembly 16 on a rear window of the same machine. At times it may be desirable to have more than one mounting assembly in order to be able to change the location of the apparatus 10. All mounting assemblies in one cab are mounted at the same height relative to the ground. Each mounting assembly 16 is disposed so that the cutaway plane of FIG. 8 is vertical when the earth moving machine is resting on horizontal ground. The apparatus 10 is easily removable so it may be placed in a location safe from theft and from contaminants such as dust or water.

Figures 3, 4:
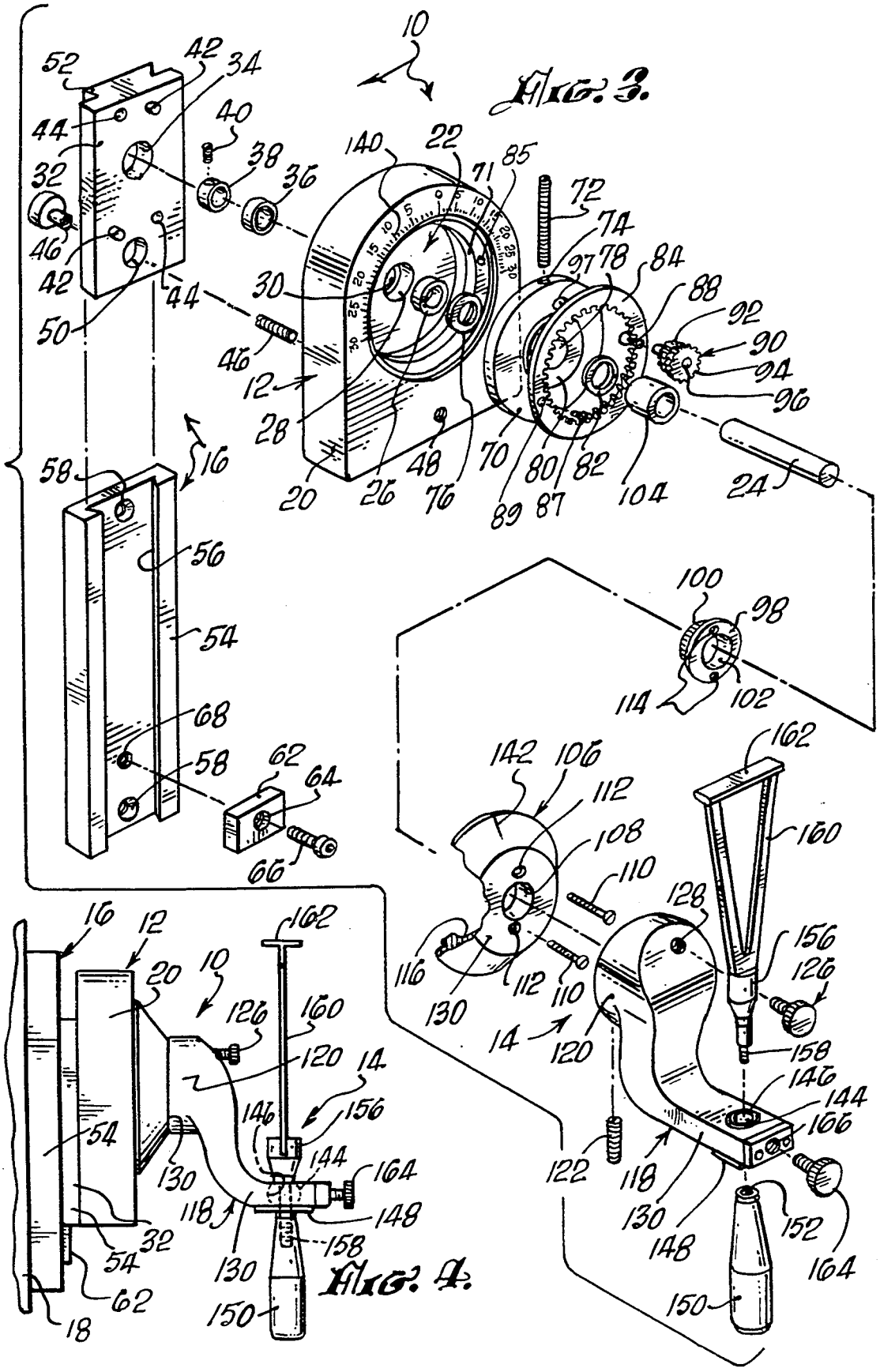
FIG. 3 is an exploded perspective view of the device of FIG. 2, with fragments broken away.
FIG. 4 is a side elevation on a reduced scale of the device of FIG. 2.

Referring to FIG. 3, the main body portion 12 comprises a block 20 which is provided with an internal cavity generally shown at 22. A central main shaft 24 is journaled in a first bushing member 26 fitted into annular groove 28 of block 20. A bore 30 communicates the inner cavity 22 with the rear face of the block 20.

A dove-tailed block member 32 is provided with an annular recess 34. This recess is shown with a second bushing member 36, similar to the first bushing member 26. The shaft 24 is journaled within the bushing 36 and is kept from shifting from right to left by a retainer sleeve 38 and its locking set screw 40. Dowel pins 42 are provided in both the block 20 and dove-tailed block 32. Dowel pin recesses 44 are correspondingly formed in each of these blocks in order to properly align these blocks in relation to each other.

After alignment, the two block members 20 & 32 are secured together by means of a lock bolt 46. Referring to FIG. 8, this bolt passes through an opening 50 of dove-tailed block member 32 and is threadably received in a bore 48 in block 20. Lock bolt 46 is tightened into bore 48, clamping blocks 20 & 32 together. Referring again to FIG. 3, the dove-tail portion of dove-tail block 32 can be inserted slidably into the mating slot 56 of mounting member 54. Mounting member 54 is secured to the cab window by screws 60, shown in FIG. 2, which pass through holes (not shown) bored in the cab window pane and nuts (not shown) on the outside of the window.

In order to properly place the apparatus 10 in a location which would be at the eye level of the machine operator, a stop member 62 is provided having an opening 64 through which a fastener 66 passes into a receiving threaded hole 68.

In this manner an accurate locating method is provided in order to put the apparatus 10 into position quickly so that the operator can readily check the position of his machine in relation to a horizontal plane, or to the inclined plane.

Within the block member 20, shown in FIG. 8, it can be seen that an enlarged annular cavity 71 is provided into which a plate member 70 rotatably is fitted. An elongated set screw 72, threaded into hole 74, affixes the plate to rotate internally with the main central shaft 24. The shaft passes through a central opening 78 in plate member 70 and is provided with a rear thrust washer 76 which furnishes a bearing surface for the back side of the plate 70. The front face of plate 70 has a raised boss portion 80 which bears against a forward thrust washer 82.

A large ring gear 84 is affixed into a further enlarged annular recess 86 in the block member 20. To secure this gear to the block member 20, threaded holes 85 are provided in block 20. Fastener screws 87 are inserted through ports 89 of gear 84 and threadably received in holes 85.

Figure 9:
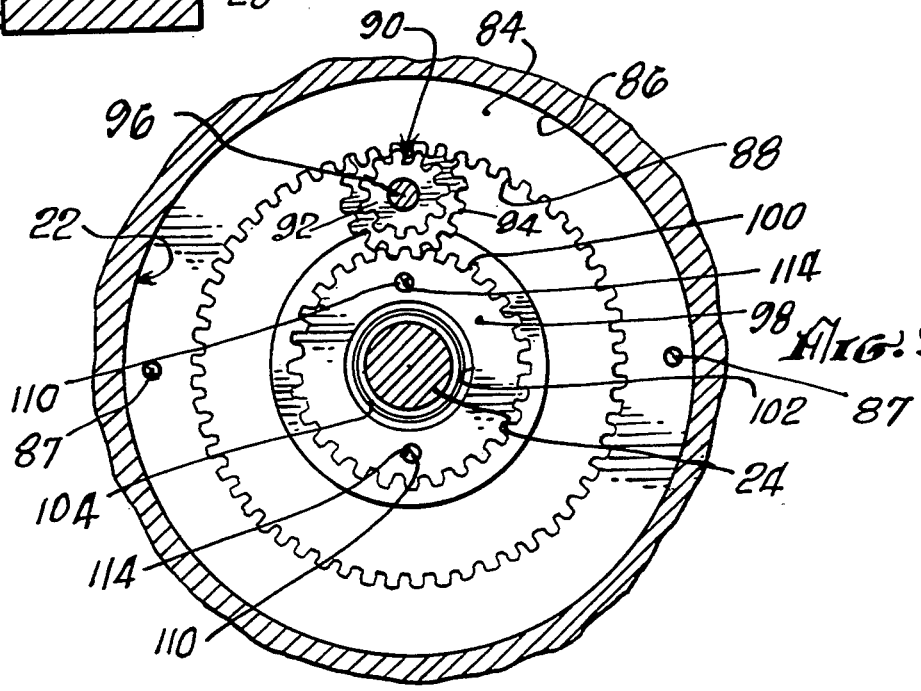
FIG. 9 is a fragmentary section as viewed along line 9—9 of FIG. 8.

Referring now to FIGS. 3, 8, & 9, a satellite gear, generally shown at 90, comprises a smaller diameter portion 92 and a larger diameter portion 94, with shaft 96 secured thereto within hole 97. This satellite gear 90 transfers rotative movement of plate 70 to sun gear 98. This sun gear 98 is secured to dial plate 106 by screws 110 which pass through holes 112 in dial plate 106 and into threaded openings 114 in sun gear 98.

Gear teeth 100, which are located on the perimeter of sun gear 98 mesh with the larger diameter gear portion 94 of satellite gear 90 and thusly impart movement to dial plate 106. As plate 70 is rotated a given number of degrees, dial plate 106 is rotated a greater number of degrees in the same direction. This action is accomplished by the annular and rotational movement of the satellite gear 90. Since the output gear portion 94 has a greater diameter than the input gear portion 92, the movement differential between plates 70 and 106 is substantial. With the diameter of output gear portion 94 set at twice the diameter of input gear portion 92, as shown and recommended, dial plate 106 will rotate three degrees for every one degree of rotation of plate 70.

Mounted onto shaft member 24, and located within bores 102 and 108 in 98 and 106, respectively, is a bearing 104. A cavity 116 is provided in dial plate 106 in order to accommodate the gear portions 94 and 98.

Secured to the central main shaft 24 at its outer end, as viewed in FIG. 8, is a sighting assembly support arm 118. This support arm includes a hub portion 120 with a cylindrical cavity into which shaft 24 is mated. Shaft 24 is held within this cylindrical cavity by a set screw 122 which is threadably received in a hole 124 located in hub portion 120 of the support arm. A thumb screw 126 is provided which is threadably received in a horizontal bore 128 in hub portion 120. Screw 126 is of sufficient length for the inserted end to contact the front face 130 of dial plate 106. By manually tightening screw 126, the arm 118 can be affixed against face 130, preventing relative movement of these two members and also preventing rotation of gear 90. Since input gear 92 is engaged with ring gear 84, rotation of plate 106 and arm 118 is prevented.

Degree markings 140 are provided on the face of block 20 around the perimeter of dial plate 106. A single indicator mark 142 is placed onto the face of the dial plate. This indicator mark points to degree markings 140. Degree markings 140 are calibrated to show the angle of arm 118 relative to the longitudinal axis of mounting assembly 16.

In order for the sighting and plumbing assembly 14 to seek a vertical condition, a ball pivot 144, incorporating a cylindrical bore 145, is located within a cavity .146 on a forwardly-extending portion 130 of support arm 118. The ball pivot member is retained in the cavity by a retainer plate 148 which is affixed to the forwardly-extending portion 130 by fasteners 151, shown in FIG. 7. A light lubricant may be employed within cavity 146 to minimize friction of ball pivot 144 against this cavity and against retainer plate 148.

A weighted plumb member 150, having a threaded hole 152, passes through an opening 149 in plate 148 and is tightened against flat face 154 on the underside of the ball pivot 144. An enlarged sighting holder hub 156, having a downwardly-extending threaded projection 158 passes through bore 145 and is threadably received in hole 152.

A support structure 160 projects upwardly from the hub portion 156 and terminates in a sighting device. This device, as shown in the drawings is a horizontal bar 162. Alternately, this bar may be replaced with a horizontal disc or wire ring, not shown. A second thumb screw 164 is provided to lock assembly 14 in place relative to arm 118. This screw is threadably received in a horizontal bore 166 in arm 118. This bore communicates cavity 146 with the center front end of arm 118. Screw 164 is of sufficient length to contact the spherical surface of ball pivot member 144. When screw 164 is manually loosened, assembly 14 is free to assume a vertical position. A bubble level, not shown, may be mounted on the assembly 14 above hub portion 156. This bubble level reads level when assembly 14 is vertical.

OPERATION OF THE PREFERRED EMBODIMENT

The present invention can be used to measure the grade of a road longitudinally (the angle of a length of the road relative to horizontal) or laterally (the angle of the road surface from one shoulder to the other shoulder relative to horizontal). For longitudinal measure, the apparatus 10 is mounted on a side window of the cab. For lateral measure, the apparatus is mounted on the rear window or front windshield.

To check elevation:

1. Release screws 126 & 164, allow assembly 14 and arm 118 to hang at equilibrium position;
2. Tighten screw 126;
3. Allow assembly 14 to hang at equilibrium position;
4. View sight line along sighting device 162 to establish a landmark of known altitude;
5. Perform earth-moving operations;
6. Allow assembly 14 to hang at equilibrium position;
7. View sight line along sighting device 162 to establish a new landmark of different altitude or to confirm the original landmark and unchanged altitude.

To perform a quick angle measurement:

1. Release screws 126 & 164, allow assembly 14 and arm 118 to hang at equilibrium position;
2. Read angle indicated by mark 142.

To perform a precise angle measurement:

1. Set earth-moving machine on a known level surface;
2. Manually set dial 106 to zero;

3. Tighten screw 126;
4. Release screw 164;
5. Allow assembly 14 to hang at equilibrium position;
6. Tighten screw 164;
7. Drive machine to position of unknown grade;
8. View sight line along sighting device 162 to establish a landmark;
9. Release screw 164;
10. Allow assembly 14 to hang at equilibrium position;
11. Tighten screw 164;
12. Release screw 126;
13. Manually rotate arm 188 until landmark established in Step 8 is again in sight line of sighting device 162;
14. Tighten screw 126;
15. Read angle indicated by mark 142.

To maintain a given longitudinal grade when a proper grade has been started, it is recommended that the apparatus be configured as in step 7 of the precise angle measurement sequence above. In this configuration, the sighting device will point to a landmark directly in front of the machine. Thus, no error will develop as the machine draws closer to the landmark. On the other hand, if a higher landmark is selected and sighted with no angle adjustment as the machine moves closer, the earth-moving machine will tend to create a concave grade as it spirals toward the landmark. It is worth noting that such a grade may be desirable in some situations.

SUMMARY, RAMIFICATIONS, AND SCOPE

It can be seen that the present invention satisfies the criteria outlined above in the Objects section. This invention makes the grading process easy and convenient. Obviating the need for the operator to exit the cab, the grading process may be performed quickly.

While the embodiments of this invention shown and described are fully capable of achieving the objects and advantages desired, it is to be understood that such embodiments are for the purpose of illustration only and not for purposes of limitation. For example, the invention may be used for surveying operations which do not involve earth moving machinery. The apparatus 10 may alternately be mounted on a stake, pole, or tripod for use as a simple and inexpensive transit in ground surveying work.

I claim:

1. A method to assist an operator of an earth moving machine to form a desired grade comprising: swing mounting a grade measuring apparatus having a main body member and a sighting device on the earth moving machine; securing said grade measuring apparatus against movement; sighting along said sighting device to determine alignment with an external object along a sight line; determining the angle of said sighting device relative to said main body member; releasing the securing of said grade measuring apparatus to allow said sighting device to hang in equilibrium position, reading the angle of said sighting device relative to said main body member; securing said sighting device relative to the main body member at a desired angle whereby said external object is sighted through said sighting device when said machine is resting on a surface formed with the desired grade.

2. The method of claim 1 wherein the method further comprises the step of moving the grade measuring apparatus from the position of its mounting to another position of mounting and repeating all of the steps of claim 1 to achieve a second grade established by sighting a second external object.

3. The method of claim of 1 wherein the method further comprises the step of providing a plumb secured to said sighting device and mounting the grade measuring device upon the earth moving machine above the horizontal prior to sighting the external object.

4. An apparatus for determination of grade upon which an earth moving machine is operating, comprising in cooperative relationship: a main body member mounted on said machine, a sighting device for determining alignment with an external object along a sight line, said sighting device mounted upon a sighting assembly, said sighting assembly mounted on said main body member via a swing mount, and said swing mount allowing said sighting assembly to swing around a horizontal axis wherein, said horizontal axis is disposed at an angle to the sight line, a manually operated securement mechanism for preventing swinging of said sighting assembly, and angle indicating means for determining the angle of said sighting assembly relative to said main body member, wherein said angle indicating means comprises a substantially ring-shaped dial and an enclosed gearing mechanism transmitting movement of said sighting assembly to said dial whereby said dial is rotated a greater number of angular degrees than said sighting assembly.

5. An apparatus as in claim 4 wherein, the ratio of dial movement to sighting assembly movement is substantially 3 to 1.

6. An apparatus for determination of grade upon which an earth moving machine is operating comprising in cooperative relationship: a main body member mounted on said machine, a sighting device for determining alignment with an external object along a sight line, said sighting device mounted upon a sighting assembly, said sighting assembly mounted on said main body member via a swing mount, said swing mount allowing said sighting assembly to swing around a horizontal axis wherein, said horizontal axis is disposed at an angle to the sight line, a plumb rigidly attached to said sighting assembly opposite said sighting device whereby said sighting device is disposed above said horizontal axis when said sighting assembly is hanging in equilibrium position, and a plurality of mounting devices affixed to said machine, wherein said main body member is easily moved from one mounting device to another.

7. An apparatus for determination of grade upon which an earth moving machine is operating comprising in cooperative relationship: a main body member mounted on said machine, a sighting device for determining alignment with an external object along a sight line, said sighting device mounted upon a sighting assembly, said sighting assembly swingably mounted on a support arm via a swing mount, said support arm rotatably mounted on said main body member, and said swing mount allows said sighting assembly to swing around a horizontal axis wherein said horizontal axis is disposed at an angle to the sight line, with angle indicating means for determining the angle of said support arm relative to said main body member, and wherein said angle indicating means comprise a substantially ring-shaped dial and an enclosed gearing mechanism transmitting movement of said support arm to said dial whereby said dial is rotated a greater number of angular degrees than said support arm.

8. An apparatus as in claim 7 wherein, the ratio of dial movement to support arm movement is substantially 3 to 1.

* * * * *